United States Patent [19]

Coone et al.

[11] Patent Number: 5,024,273

[45] Date of Patent: Jun. 18, 1991

[54] CEMENTING APPARATUS AND METHOD

[75] Inventors: Malcolm G. Coone, Katy; Jeffry C. Ehlinger, Houston; Frank Cole, Sugarland, all of Tex.

[73] Assignee: Davis-Lynch, Inc., Houston, Tex.

[21] Appl. No.: 504,337

[22] Filed: Apr. 4, 1990

Related U.S. Application Data

[63] Continuation-in-part of Ser. No. 415,670, Oct. 2, 1989, abandoned.

[30] Foreign Application Priority Data

Sep. 29, 1989 [CA] Canada ..... 614995

[51] Int. Cl.[5] ..... E21B 33/14; E21B 34/10

[52] U.S. Cl. ..... 166/289; 166/154; 166/184; 166/187; 166/285; 166/317; 166/383

[58] Field of Search ..... 166/285, 289, 154, 317, 166/374, 387, 383, 386, 187, 184

[56] References Cited

U.S. PATENT DOCUMENTS

| | | | |
|---|---|---|---|
| 3,503,445 | 3/1970 | Cochrum et al. | 166/244.1 |
| 3,524,503 | 8/1970 | Baker | 166/289 |
| 3,606,924 | 9/1971 | Malone | 166/187 |
| 3,768,562 | 10/1973 | Baker | 166/289 |
| 3,811,500 | 5/1974 | Morrisett et al. | 166/153 X |
| 3,948,322 | 4/1976 | Baker | 166/154 X |
| 4,421,165 | 12/1983 | Szarka | 166/289 X |

OTHER PUBLICATIONS

"Sub-Surface Cementing Equipment", *Composite Catalog of Oilfield and Pipeline Equipment*, 1986–1987, pp. 2442–2443.

Lynes Brochure, "There's Something New Inside the Lynes ECP", 10–81.

Davis-Lynch, Inc., Technical Unit 100, "Integral Casing Packer", Houstion, Tex., Nov. 1988, 8 pages.

*Primary Examiner*—Stephen J. Novosad

*Attorney, Agent, or Firm*—Vaden, Eickenroht, Thompson & Boulware

[57] ABSTRACT

Apparatus is disclosed for use in placing cement within the annulus between a casing string and a well bore in which the casing string is suspended, such apparatus including a stage collar connectible as part of the casing string and having a packing element mounted thereon and adapted to be inflated into engagement with the well bore, one or more side ports through which cement may be circulated into the annulus above the packer, tubular members or sleeves for opening and closing the ports following inflation of the packing element.

24 Claims, 7 Drawing Sheets

CEMENTING APPARATUS AND METHOD

This application is a continuation-in-part of our copending patent application, Ser. No. 07/415,670, filed Oct. 2, 1989 abandoned, entitled "Cementing Apparatus".

This application relates to improved apparatus for use in placing cement at a desired location within the annulus between a casing string and a well bore. More particularly, in one of its novel aspects, it relates to improvements in apparatus of this general type which includes an inflatable packer for closing off the annulus beneath the location in which the cement is to be placed.

Apparatus of this general type is frequently used in stage cementing—i.e., in placing cement sequentially at successively higher locations within the annulus. Typical apparatus of this type includes a so-called stage collar connected in the casing string adjacent each location and having one or more ports through which cement may be circulated from the casing string into the annulus. A first tubular member or opening sleeve is disposed within the bore of the collar and initially connected to the collar in an upper position in which it is disposed over the port to close it. Following placement of cement at the lower stage, a plug is lowered through the casing onto a seat on the sleeve, and fluid pressure is introduced into the casing string above the plug to shear the connection of the sleeve to the collar and lower it to a position to open the port. At this time, cement may be circulated downwardly through the casing and out the port into the annulus.

The apparatus also includes another tubular member or closing sleeve which is disposed within the bore of the collar above the opening sleeve and releasably connected to the collar in an upper position in which it is above the ports. Following circulation of cement through the port, a second plug is lowered onto the closing sleeve and fluid pressure is introduced into the casing above the plug to shear the connection of the closing sleeve to the collar and move it downwardly to a position over the ports to close it. At this time, additional cement may be placed at other locations thereabove through similar apparatus.

There are occasions in which it is necessary or at least desirable to inflate a packer beneath the ports in order to close the annulus below the location at which cement is to be placed. For example, it may be necessary to prevent the cement from entering a lost circulation zone of the well bore beneath the zone in which cement is to be placed, or, it may be necessary to protect a slotted liner connected to the casing string below the collar.

For this latter purpose, it has been proposed to provide such apparatus with a packer element including an inflatable sleeve of elastomeric material beneath the port, and to inflate the sleeve by means of pressure fluid introduced through the casing string into passageway means connecting with a space between the collar and sleeve. More particularly, as shown in U.S. Pat. No. 3,948,322, it has been proposed to lower a plug onto a sleeve which is initially releasably connected to the collar in a position closing the connection of the passageway means to the bore, and then introduce pressure fluid into the casing above the plug in order to shear the connection and thus open the connection of the passageway means to the bore, whereby the fluid may be supplied to the space to inflate the sleeve. When the sleeve has been inflated, pressure fluid is retained in the sleeve to hold the sleeve inflated by means of a one-way valve in the passageway means.

At this time, the pressure of the fluid in the casing string above the plug is increased in order to release shearable means connecting another sleeve to the collar and move it to a position opening the ports in the collar. When cement has been circulated through the open ports, another plug is lowered onto still another sleeve in order to release its shearable connection to the collar and thus lower it to a position closing the port.

Since the passageway means leading to the space between the collar and packer sleeve remains open to the pressure fluid in the casing string, as the opening sleeve is moved to open the side ports and cement is circulated through them into the annulus, the increased pressure is free to pass through the one way valve into the space, and, if the squeeze pressure on the cement is high, damaging the packing element. Also, of course, this apparatus is relatively expensive and time consuming to use since it requires the application of three separate levels of pressure to inflate the packer, open the ports and close the ports. Still further, due to the arrangement of its sleeves and the passageway means leading to the space within the packing element, the apparatus is not only of complex and expensive construction but also of such thickness as to either or both increase its outside diameter and decrease its inside diameter, making it difficult if not impossible to use in "tight" holes. The construction is further complicated by arrangement of the packing element which is fixed at its lower end and thus requires still another sleeve at its upper end slidable over the outer diameter of the collar to form the passageway means into the space within the sleeve.

The apparatus of U.S. Pat. No. 4,421,165, which was an apparent attempt to simplify the construction of U.S. Pat. No. 3,948,322, includes a packing element disposed about a lower extension of the collar and having passageway means leading to the spacing between the extensions and sleeve which opens to the casing string at its lower end. More particularly, the passageway means is normally closed by a shearable closure extending into the bore of the extension and adapted to be opened by a first plug lowered through the casing string to shear off the inner end of the closure. Thus, when the plug has bottomed out and pressure in the casing string is increased, the packing element is inflated following completion of the first stage. At this time, with pressure contained in the space to maintain the packer inflated, additional plugs are lowered and pressure suitably applied thereabove in order to sequentially lower a first sleeve to open the ports in the collar above the packer, circulate cement through the ports in order to place it in the annulus above the packer, and lower the second sleeve to close the ports.

Although this apparatus protects the packer against over-pressurization, and is an improvement upon the apparatus of U.S. Pat. No. 3,948,322 in this respect, it nevertheless requires lowering of a third plug in order to initially prepare the packer for inflation. Also, and as in the case of the prior apparatus, the sleeve of the packer element is fixed at its lower end and thus requires a slidable sleeve at its upper end. Still further, the apparatus is necessarily long and expensive to manufacture.

An object of this invention is to provide apparatus of this general type which overcomes these and other problems with the prior apparatus.

A more particular object is to provide such apparatus in which the packer is not only protected against overpressurization, but also prepared for inflation without the need for lowering and pressurizing a third plug.

A further object is to provide such apparatus which is of minimum thickness between its inner and outer diameters, which requires less sleeves and other ports which require the maintenance of dynamic seals, and which is of relatively short length.

Still another object is to provide such apparatus in which the inflatable sleeve of the packer element is fixed and supported at its upper end so that its lower end may be raised over a receded diameter portion of the collar as the 5 sleeve is inflated.

These and other objects are accomplished, in accordance with the illustrated embodiment of the invention, by apparatus which includes, as in prior apparatus of this type, a body or collar having a bore through it which is connectible as part of the casing string and ports connecting the bore with its outer side, and a packing element including an inflatable sleeve surrounding the body below the ports, with the body having passageway means therein connecting its bore with the space between the sleeve and body. More particularly, in accordance with the novel aspects of this invention, it also includes a tubular member or opening sleeve which has a bore therethrough as well as an upwardly facing seat and passageway means therein connecting its bore with the outer side, the member being disposed within the bore of the body or collar for vertical reciprocation between an upper position in which it is releasably connected to the body and in which it closes the port in the body and its passageway connects with the passageway means in the body, and a lower position in which it opens the port, as well as a plug lowerable through the casing string into a landed position on the seat on the opening sleeve, and having a port therethrough and means thereabout for sealably engaging the bore of the member, when landed on the seat, to connect the port in the plug and thus the casing string thereabove with the passageway means in the member. More particularly, the member has means thereon for closing the passageway means, but adapted to be moved to open position by the plug, as the plug is landed, whereby pressure fluid in the casing string above the plug may be supplied to the space in order to inflate the sleeve of the packer element into engagement with the well bore beneath the port, and when the packer has been inflated, release the connection of the member to the body and move the tubular member to its lower position to open the port and thus permit cement to be circulated through the open port in the body and into the annulus above the inflated sleeve, the tubular member and bore of the body having means for holding the member in its lower position.

More particularly, a means is provided for closing the passageway means in order to contain such pressure fluid within the space and prevent the supply thereto of additional pressure fluid in the casing string above the plug following inflation of the sleeve. Thus, it is possible to avoid damage to the packer by squeeze pressure on the cement as it is circulated through the ports and into the annulus, without the need for an additional plug —i.e., with only the single plug lowered into the tubular member or opening sleeve which opens the passageway means leading to the space between the packer sleeve and body and then opens the ports in the body.

In accordance with one embodiment of the invention, the shear means connecting the member to the body is shearable in response to fluid pressure in the casing string above the plug which is greater than that which was required to inflate the sleeve, and the means for closing the passageway means comprises means for sealing between an imperforate portion of the outer side of the member and the bore of the body above and below the connection of the passageway means in the body upon movement of the member to its lower position. Preferably, the sealing means is sealably slidable along equal diameter portions so that there is no risk of fluid lock above the passageway means leading to the space between the packing element and body as the opening sleeve is lowered.

In accordance with another embodiment of the invention, the means for closing the passageway means comprises valve means which includes a valve member installed in the body for movement between positions opening and closing the passageway means in the body, means holding the valve member in open position, and means responsive to the supply of the passageway means of pressure fluid to inflate the sleeve for releasing the holding means and moving the valve member to closed position in which it is held by the fluid pressure in the space regardless of fluid pressure supplied to the casing. More particularly, the valve means also includes an additional valve member installed in the body for movement between positions opening and closing passageway means in the body upstream of the first mentioned valve member, means urging the additional valve member to closed position but yieldable to permit the additional valve member to be moved to open position in response to the supply of said pressure fluid to the passageway means for inflating the sleeve, and means for locking said additional valve member in its closed position when returned thereto by said urging means upon the reduction of pressure fluid.

In the preferred and illustrated embodiment of the invention, the body has a lower reduced outer diameter portion, the sleeve is fixed to the upper end of the upper body portion to surround the lower portion, and the packing element also includes a ring on the lower end of the sleeve sealably slidable along the lower body portion. Thus, as the packer is inflated and expanded, the ring moves upwardly along the reduced outer diameter portion of the body so as to minimize the radial thickness required to accommodate the packer by virtue of the fact that it does not have to slidably move over the upper enlarged diameter portion of the body in which the tubular member or opening sleeve is contained. More particularly, the sleeve is made of an elastomeric material and has metal strips extending between its upper and lower ends, and the ring and lower portions of the body have means which are engageable with one another as the ring is raised to hold the sleeve in its expanded or set position, whereby due to the metal reinforcement of the sleeve, the packer may remain in its expanded or set position even though pressure fluid is lost in the space between the packer and body.

As in the case of prior apparatus of this type, it also includes another tubular member or closing sleeve which is vertically reciprocal within the bore of the body above the first-mentioned tubular member or opening sleeve between an upper position in which it opens the ports in the body, during circulation of cement through the ports, and a lower position in which it closes the ports following circulation of cement. Shear means releasably connects the other tubular member or closing sleeve in its upper position, and another plug is lowerable through the casing string and into a landed position on the other member, whereby pressure above it is effective to release the shear means and lower the other member to its closing position, the other member being located and held in its lower position by suitable means.

In its preferred embodiment, the means by which the connection of the passageway means in the tubular member is closed comprises a closure mounted in the passageway means and extending into the bore of the member in order to be engaged and thereby removed from the passageway means by the plug as it is lowered into landed position.

The disclosed embodiments of the invention also contemplate that, in the event pressure fluid is not able to shear the connection of the first tubular member to the body and move it to its lower open position, a pipe string may be lowered through the casing string and onto the seat in the plug and sealed with respect thereto above the port to permit pressure fluid to be circulated downwardly therethrough and into the port and a downward force to be applied by the pipe string to the plug to shear the connection of the member to the body and lower the member to its lower position. In addition to permitting this downward force to be applied to the plug, the lower end of the pipe string permits pressure fluid to be supplied to the packer, which of course would not be possible by merely dropping a ball or other closure onto the plug.

In apparatus of the type described, the opening sleeve is a relatively long tubular member which is releasably connected to the bore of the body in its upper position by shear pins. Due to its length, and the resulting large area of frictional resistance between it and the bore of the body, it may be difficult to shear its connection to the body and lower it to port opening position in response to the desired pressure level. In any event, its movement, and thus the opening of the ports, and, in one embodiment of the invention, closing of the passageway means leading to the packer, is rather unreliable, thus raising the risk of over pressurizing the packing element before the sleeve is released to open the port. It is therefore still another object of this invention to provide such apparatus in which the movement of the opening is more reliable.

This and other objects are accomplished, in apparatus made in accordance with the first embodiment of the invention, by an opening plug which comprises an outer plug body having a bore therein and disposable within the bore of the tubular member for landing on the seat thereof, and an inner plug body having a bore therein and disposable within the bore of the outer plug body for moving between upper and lower positions therein, the port means in the plug comprising ports in each of the inner and outer plug bodies connecting their bores with their outer sides and means being provided for sealing between the first and second plug bodies and between the outer plug body and the bore of the member so as to connect the ports and thus connect the port means with the passageway means in the member when the inner plug body is in its upper position, the space between the lower ends of the plugs being vented to permit the inner plug body to be lowered. More particularly, means are provided for holding said inner plug body in its upper position but releasable, in response to an increase in fluid pressure above the plug above that required to inflate the sleeve, but less than required to move the opening sleeve to its lower position, so as to lower the inner plug body to its lower position, and for sealing between the plug bodies to close the connection between their ports and thus close the port means when the inner plug body is moved to its lower position. Due to its short length, the release and lowering of the inner plug body is more predictable, thus permitting the passageway means to be closed before the opening sleeve is lowered, so as to prevent over pressurizing the packing element.

There is a further risk, in the use of apparatus of this general type, that the closing sleeve will not fully move down to its lower position, or will not, for some other reason, be locked in its lower position. In this case, the closing plug must be held down on the sleeve with pressure above it to prevent heavier cement in the annulus from flowing through the ports and back into the casing. Then, when the cement in the annulus has hardened, and pressure above is reduced, the casing may contract and leave spaces or voids between the outer side and the inner wall of the cement column. It is therefore yet a further object of this invention to provide apparatus of this general type in which heavier cement will be contained beneath the plug, even though the opening sleeve is not locked down in its lower position, and without having to hold pressure above the plug.

This further object is accomplished, in accordance with another novel aspect of this invention, by apparatus of this general type in which a means is provided for connecting the plug to the closing sleeve as the plug is lowered into its bore, so as to permit said plug to reciprocate within said bore between a lower position in which it is landed on the seat of the closing sleeve and an upper position in which it is raised from the seat, and in which means are provided on the plug which sealably engages the bore of the closing sleeve in the upper position of the plug, but is removed from the bore to open a flow path between the plug and the opening sleeve as the plug is lowered toward its landed position. More particularly, as illustrated, the connecting means comprises a groove about one of said bore of the closing sleeve and outer side of the plug, and expandable and retractable locking means carried by the other of the bore of the closing sleeve and outer side of the plug for moving into the groove as the plug is lowered into the bore of the closing sleeve, the groove being of a length to permit said plug to reciprocate between its upper position and lower landed position and thus permit cement to intermittently flow therepast to equalize pressure above and below the plug until the plug moves upwardly to its upper position in the bore of the sleeve to close it. Finally, the opening sleeve is free to move upwardly beyond its position until it engages a shoulder on the bore of the body thus limiting upward movement of the sleeve and body to contain cement therebelow.

In the drawings, wherein like reference characters are used throughout to designate like parts:

FIGS. 1A and 1B are views partly in elevation and partly in vertical section of the upper and lower ends of the apparatus, with the packer shown in deflated position and broken away or discontinued intermediate its upper and lower ends, and the tubular member or opening sleeve in its upper position closing the ports in the body or collar of the apparatus;

FIGS. 2A and 2B partial vertical sectional views of the upper and lower ends of the apparatus, similar to FIGS. 1A and 1B, but upon lowering of an opening plug onto a seal in the tubular member to move the closure in the passageway means of the first tubular position to open position and thereby permit pressure fluid above the plug to be circulated into the passageway means leading to the space between the packing sleeve and body in order to inflate the packer into engagement with the well bore in which the apparatus is disposed;

FIG. 3 is a full sectional view of the upper end of the apparatus, but upon the continued application of fluid pressure to the casing string above the plug to cause the connection of the upper member to the body to be sheared and the member to be lowered to open side ports in the body, whereby cement may be circulated through the side ports into the annulus above the inflated packer;

FIG. 4 is a partial vertical sectional view similar to FIG. 3, but following placement of cement in the annulus above the packer, and lowering of another plug onto another tubular member or closing sleeve mounted in the bore of the body above the opening sleeve, and upon application of pressure fluid to the string above the other plug to shear the connection of the closing sleeve to the body and move the opening sleeve downwardly with the plugs to a position in which it closes the side port;

FIG. 5 is a vertical sectional view of the apparatus showing the lower end of a pipe string lowered through the casing string and seated upon the plug seated on the first tubular member and sealed with respect to it above the port in the plug, so that pressure fluid may be circulated downwardly through the pipe string slacked off to release the connection of the tubular member to the body and lower the tubular member to a position opening the side ports, as shown in FIG. 3;

Figure 8:
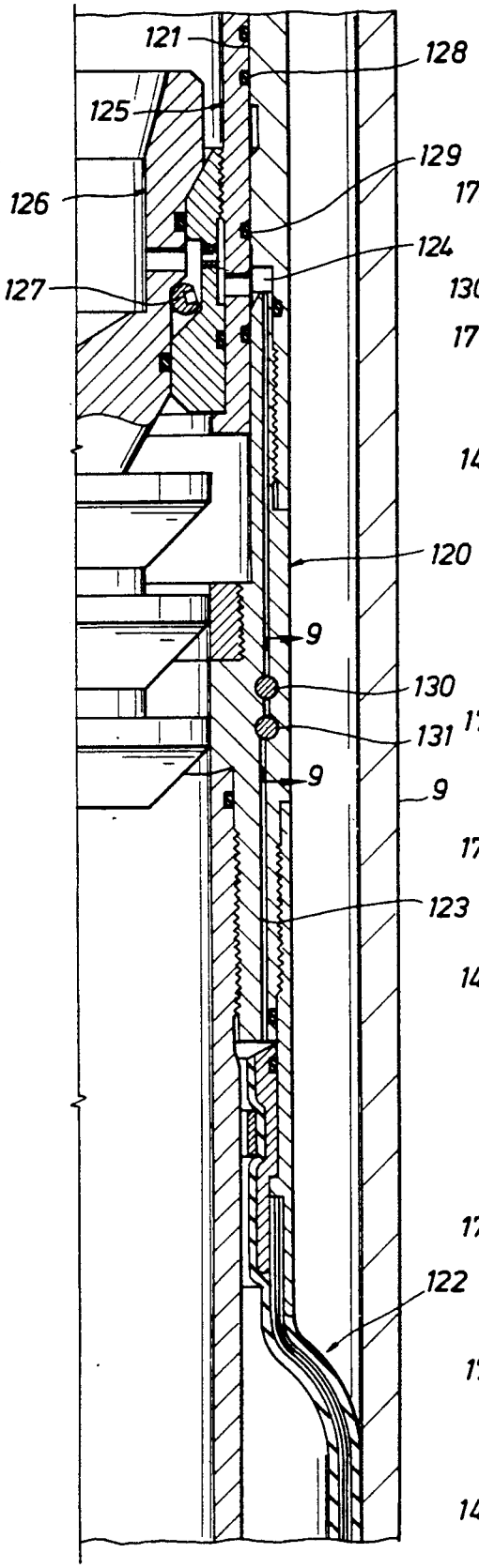
FIG. 8 is a partial vertical section view of the alternative embodiment of the apparatus, with the packer shown in inflated position following the supply thereof to pressure fluid through the valve means disposed within the passageway means of the body of the apparatus at the locations indicated by circles.
Figure 9A:
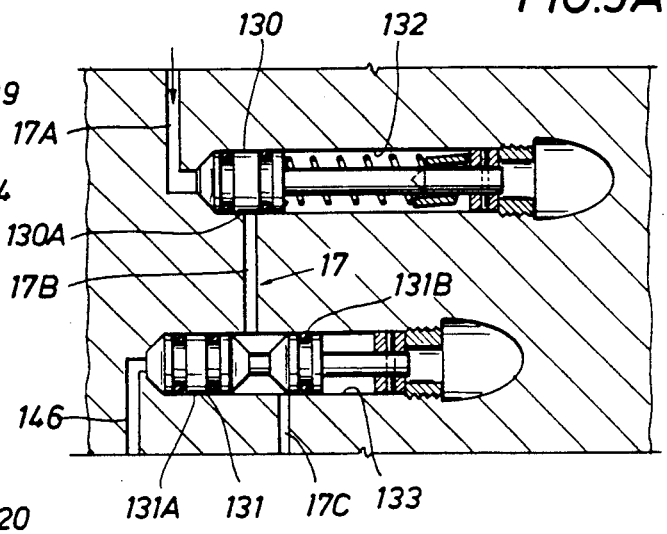
Figure 9B:
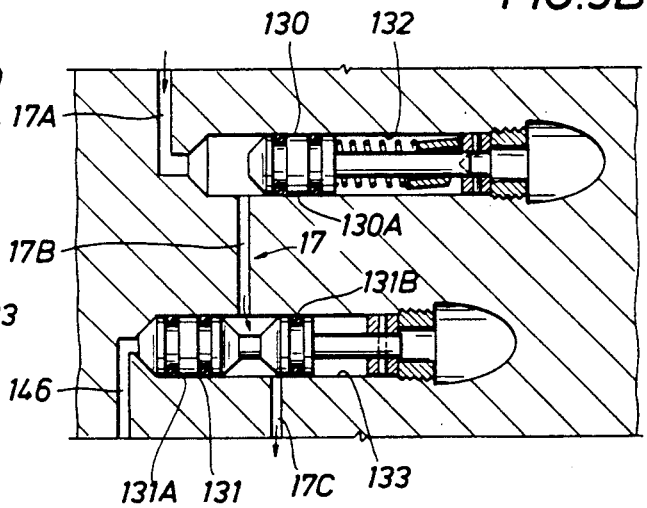
Figure 9C:
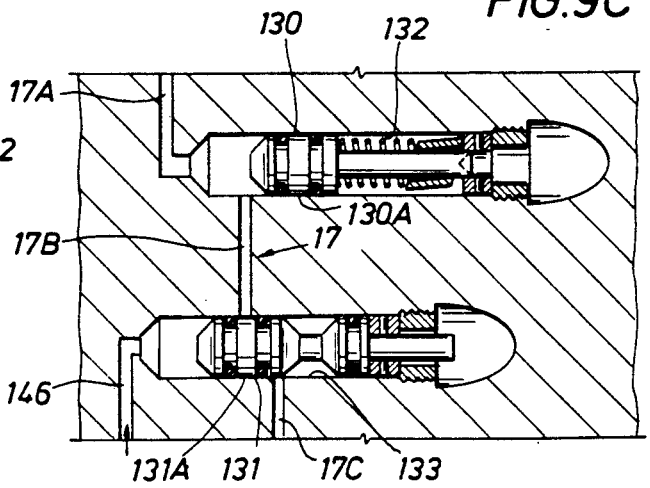
Figure 10:
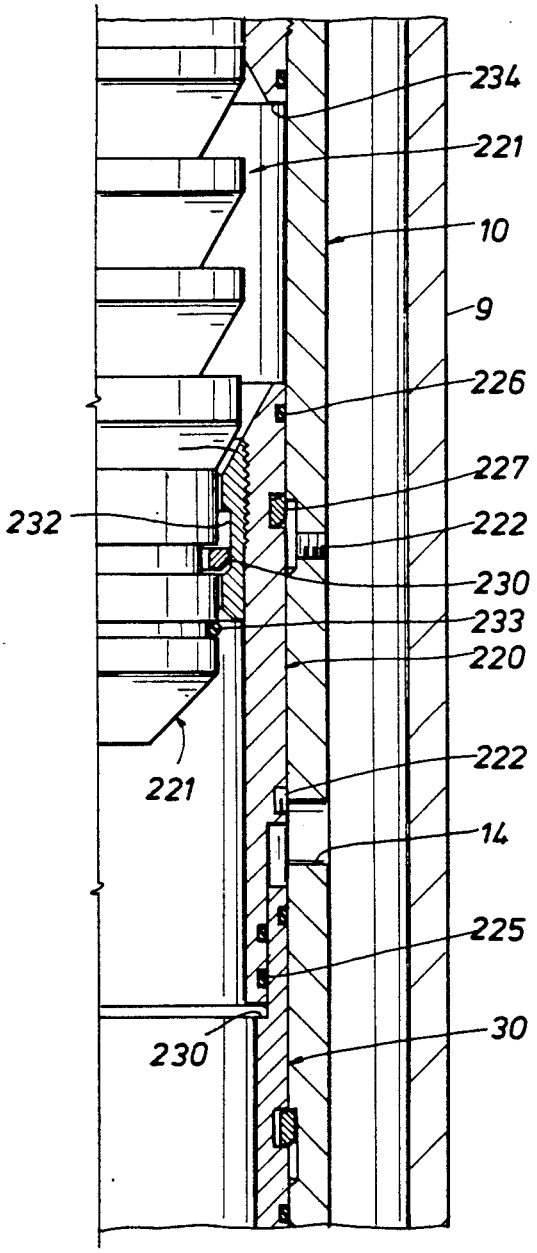
Figure 11:
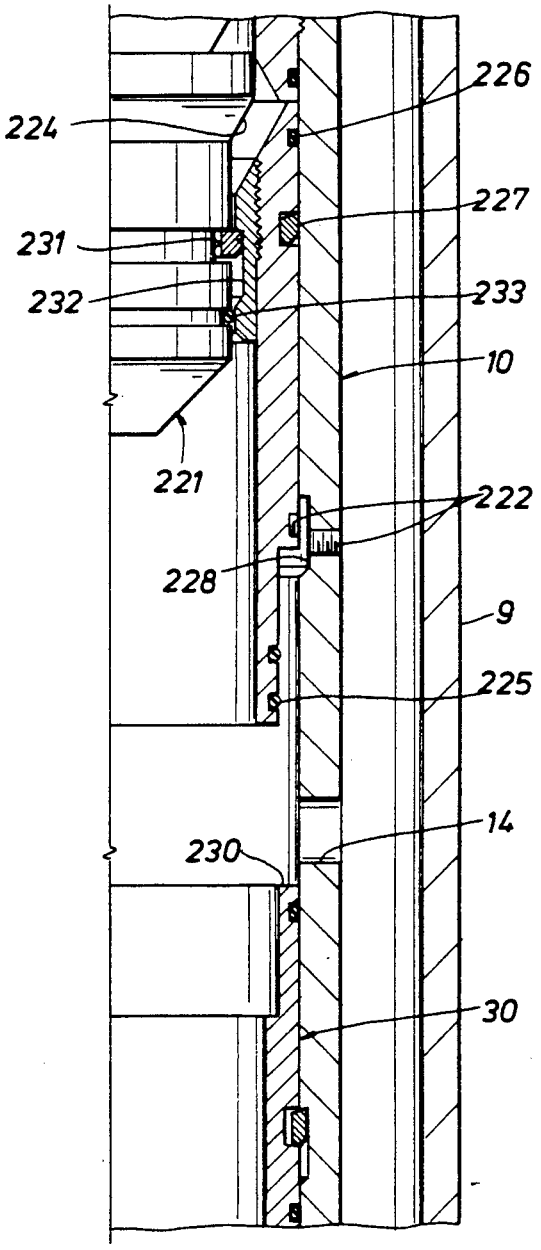

FIGS. 9A, 9B and 9C are enlarged sectional views of the valve means shown diagrammatically in the circled parts of FIG. 8, and as seen along broken lines 9—9 thereof, including upper and lower valve members shiftable between positions opening and closing the passageway means, the upper valve member being shown in closed and open positions and the lower valve member in open position in FIGS. 9A and 9B, prior to and during the supply of packer inflating pressure, respectively, and the lower valve member being shown in closed position in FIG. 9B, following inflation of the packer, to prevent the escape from or the supply of additional pressure fluid to the packer;

FIG. 11 is a vertical sectional view of an alternative version of a closing sleeve having a closing plug landed thereon, with the plug and closing sleeve lowered in response to pressure thereabove to move the lower end of the closing sleeve into sealed engagement with the opening sleeve in order to close the cement circulating port in the body of the apparatus; and FIG. 11 is a view similar to FIG. 10, but showing the opening sleeve raised to its upper limited position within the body to open the port, following failure to lock to the body in its lower positions, and with the plug raised within the sleeve to contain cement beneath the plug.

Figure 1A:
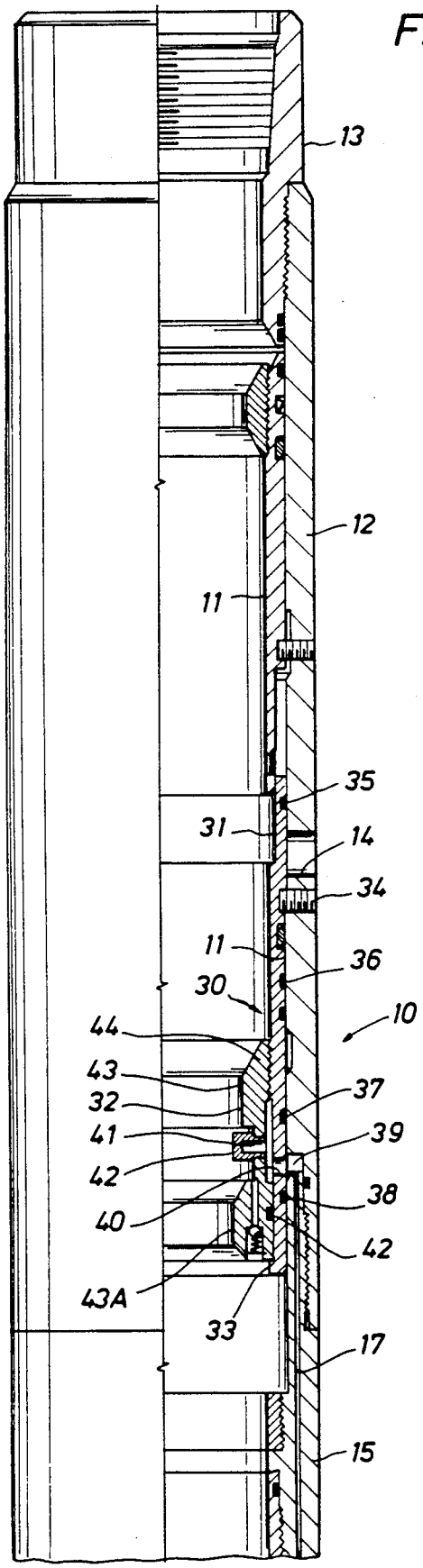
Figure 1B:
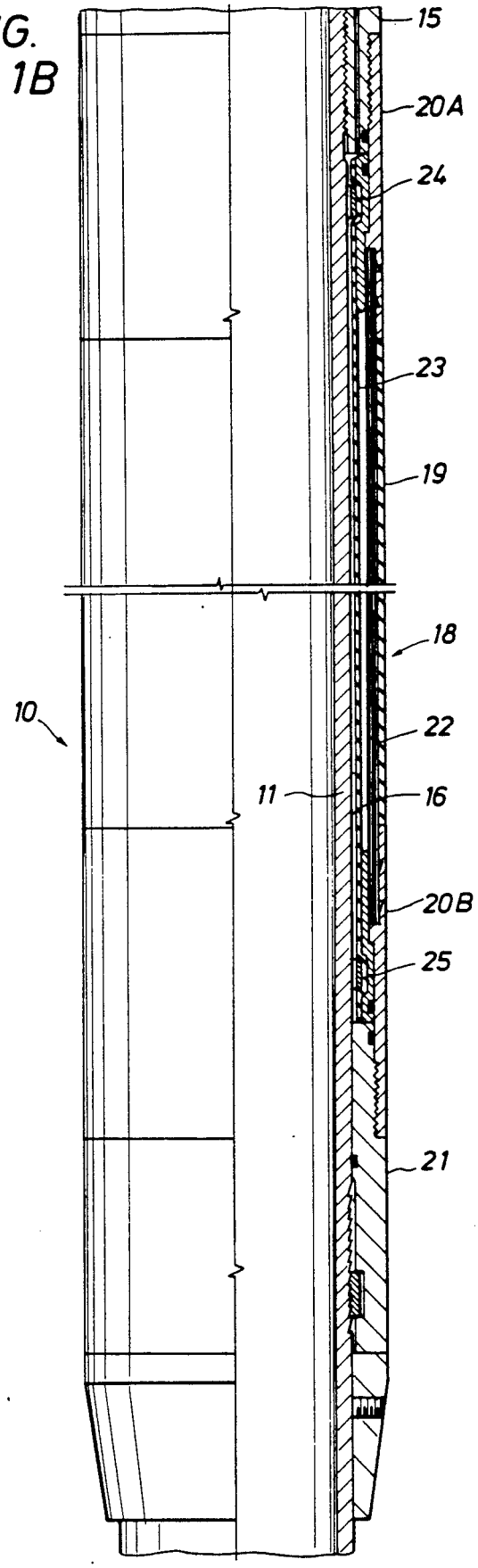
Figure 2A:
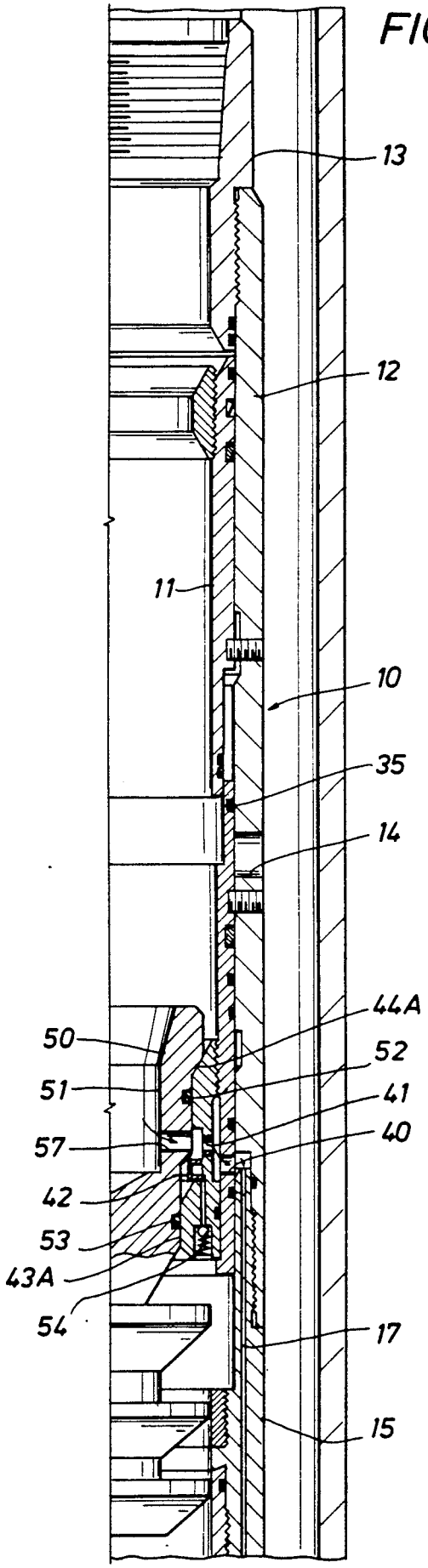
Figure 2B:
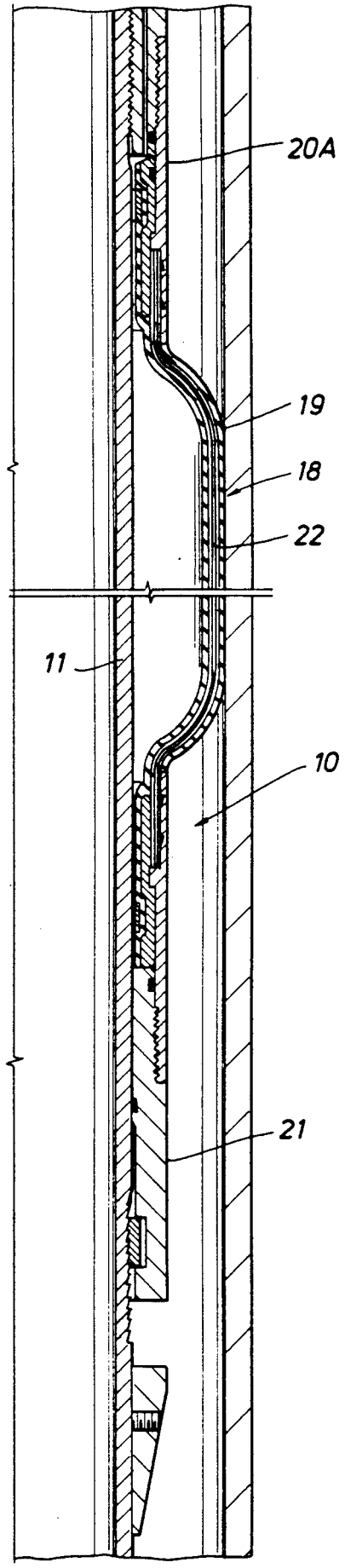

With reference now to the details of the above described drawings, the embodiment of the overall apparatus shown in FIGS. 1A, 1B, 2A and 2B includes a body indicated in its entirety by reference character 10 and connectable in a pipe string (not shown) to permit it to be lowered into a well bore, such as casing string 9 shown in FIGS. 2A and 2B, although as used herein, "well bore" means either an open hole or a cased hole. The body, known as a "collar" in the art of stage cementing, has a bore 11 forming a continuation of the pipe string and includes an upper pipe 12 having a sub 13 at its upper end for connection to the lower end of an upper portion of the pipe string, an intermediate pipe 15 threadedly connected at its upper end to the lower end of the upper pipe 12, and a lower pipe 16 threadedly connected to the pipe 15 and extending downwardly therefrom for connection at its lower end to the upper end of the lower portion of the pipe string. The upper pipe 12 of the body has ports 14 formed therein connecting the bore of the body with its outer side and thus with the annulus about the body, and the intermediate pipe 15 has one or more passageways 17 formed therein to connect its upper with its lower end.

The outer diameter of the lower pipe 16 of the body is of reduced outer diameter and a packing element indicated in its entirety by reference character 18 mounted about the lower pipe is shown to comprise an outer sleeve 19 of elastomeric material extending between a sleeve 20A at its upper end for threaded connection to the outer diameter of the lower end of intermediate pipe 15, a sleeve 20B on its lower end connected to a ring 21 which is sealably slidable along the lower pipe 16 of the reduced outer diameter portion of the body. As previously described, the sleeve is reinforced by vertically extending metal strips 22 disposed within it and fixed at their upper ends to the sleeve 20A and at their lower ends to the sleeve 20B. More particularly, the packing elements also include an inner sleeve 23 of elastomeric material on the inner side of the metal strips and extending between a head 24 at its upper end mounted within upper sleeve 20A and a head 25 at its lower end mounted within lower sleeve 20B. Reference is made to my copending patent application, Ser. No. 301,862, filed Jan. 26, 1989, and assigned to the assignee of the present application, for a more detailed description of a packing element of this construction.

As shown, the inner sleeve 23 is spaced outwardly from the outer diameter of the reduced diameter portion of the body to provide an annular space between them connecting at its upper end with passageway means 17, whereby, as will be described, inflating pressure fluid may be introduced into the space to inflate the sleeves and thus the metal strips 16 of the body to permit the outer sleeve to be expanded into sealing engagement with the well bore in which the casing string is suspended. As shown, the lower end of the passageway means 17 connects with this space so as to permit pressure fluid to be supplied thereto, all in a manner to be described below.

The apparatus further includes a first tubular member or opening sleeve which is indicated in its entirety by reference character 30 and which includes a first outer pipe 31 which is disposed within and slidable vertically with respect to the bore 11 of the body 10, and a second inner pipe 32 which is threadedly connected to the inner diameter of the pipe 31 intermediate its upper and lower ends with its lower end seated upon a flange 33 at the lower end of the pipe 31. As shown in FIG. 1A, the tubular member 30 is held in an upper position, wherein it is disposed over the ports 14 by means of one or more shear pins 34 releasably connecting it to the body 10. More particularly, seal rings 35 and 36 are carried about the outer diameter of the pipe 31 for sealably engaging the bore of the body above and below the ports when the first tubular member 30 is in its raised position. Additional seal rings 37 and 38 are carried about the outer diameter of the pipe 31 in position to sealably engage an annular space 39 between the pipes 12 and 15 of the body at the upper end of the passageway means 17 as well as above and below ports 40 in the outer pipe 31 which fluidly connect an annular space about the inner diameter of pipe 32 with the space.

Another port 41 is formed in the inner pipe 32 of the tubular member to connect the bore 43 of the member 30 with space 39, and a seal ring 42 is carried about the inner pipe for sealably engaging the inner diameter of the outer pipe 31 below the port 40 in the outer pipe and the port 41 in the inner pipe. Thus, in the upper position of the member 30, the port 41 is fluidly connected to the port 40 and thus to the space 39 at the upper end of the passageway means 17. The port 41 in the tubular member is initially closed by a closure or knock-off plug 45 whose inner end projects inwardly of the bore 43 below an upwardly facing seat 44 at the upper end of the bore.

Figure 3:
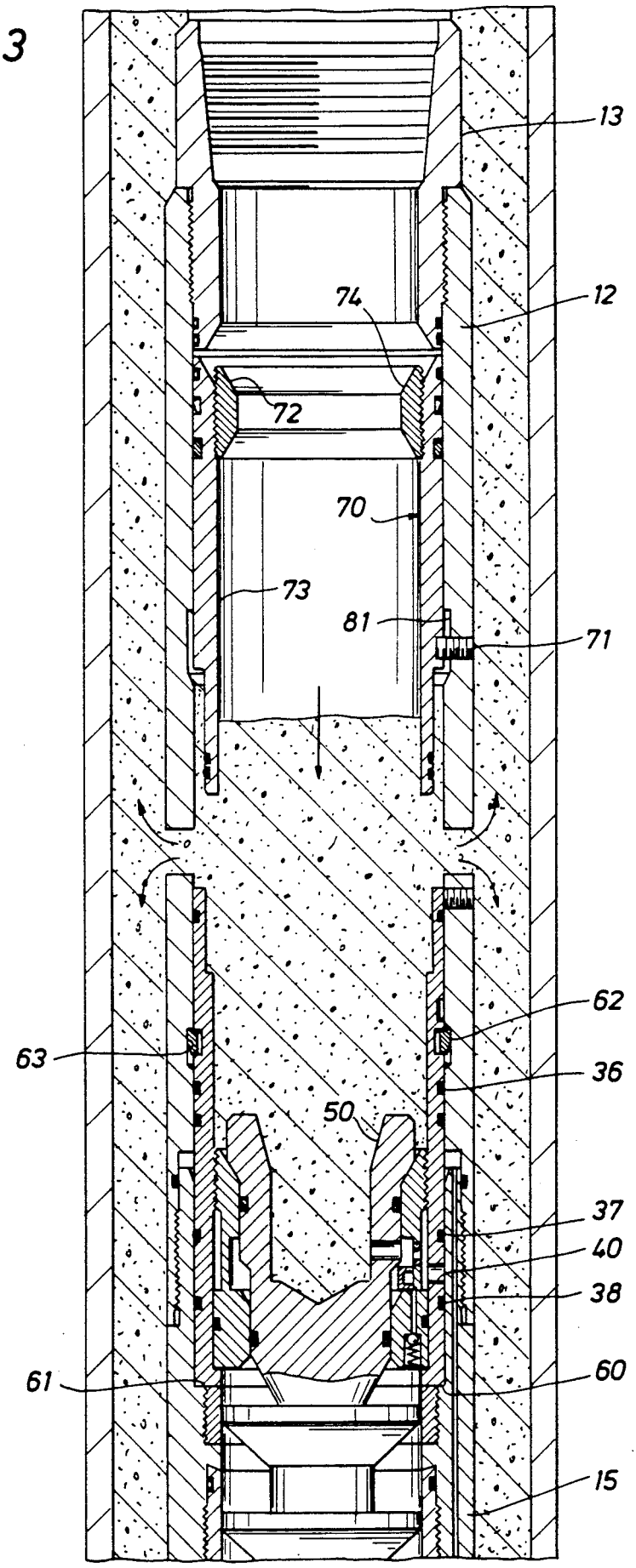

The apparatus further includes an opening plug 50 which, as shown in FIGS. 2A and 2B, is adapted to be lowered downwardly through the casing string and into a position in which a shoulder 44A thereabout lands on the seat 44, as shown in more detail in FIG. 3. The plug has a lower closed end and ports 57 through the side thereof connecting its bore above the closed end with its outer side below the shoulder 44A. More particularly, seal rings 52 and 53 are carried about the outer side of the plug 50 for sealably engaging the upper and lower portions of the bore 43 in member 30 and thus above and below the ports 57 as well as the port 41 of the tubular member. The lower end of the larger outer diameter portion of the plug is thus adapted to engage and remove the outer end of the closure 45 to thereby shear it off to open the port 41 for fluidly connecting the bore of the plug and the casing string thereabove with the upper end of passageway means 17. As shown in FIG. 2A, the outer end of the closure has been sheared from its inner reduced end in passageway 41 and has fallen into a space between the outer side of the plug and the inner side of the tubular member.

With the casing string above the plug 50 thus fluidly connected with the passageway means 17, pressure fluid may be supplied downwardly through the casing string and into the packing element for inflating it into sealing engagement with the casing 9, as shown in FIG. 2B. As also shown, the plug carries lips about its lower end which permit it to be pumped downwardly through the casing string into landed position on the tubular member. It should be understood, however, that the plug could instead be lowered into seated position merely by its weight.

After the fluid pressure has inflated the packer, as shown in FIG. 2B, it is effective to shear the pins 34 and thus release the tubular member 30 for lowering with respect to the body. Thus, as fluid pressure continues to be applied to the plug landed on the tubular member, the lower end 60 of the outer pipe of the tubular member lands upon a seat 61 formed on a reduced inner diameter portion of the intermediate pipe 15 of the body so as to locate the tubular member in its opening position in which its upper end has moved below the port 14 in the body. At this time, a snap ring 62 or the like carried about the upper pipe of the tubular member engages within a groove 63 about the inner diameter of the body 10 to hold the tubular member down in its open position.

When the first tubular member has moved to its lower position, the O-ring 36 thereabout will sealably engage the bore of the body above the space 39, while the O-ring 37 carried thereabout will sealably engage the bore of the body beneath the space, thereby closing the fluid connection between the upper end of the passageway means 17 and the port 40 and thus, through the port 41, with the casing string above the plug. As a consequence, pressure fluid is captured and contained within the space within the packing element to maintain it inflated. As previously mentioned, each of seal rings 36, 37 and 38 are of equal outer diameter, thereby avoiding the possibility of a fluid lock as the member 30 moves to its lower position. At this time, cement may be circulated downwardly through the pipe string and into the body for passage outwardly through the ports 14 and thus into the annulus between the casing string and the well bore above the inflated packer.

Figure 4:
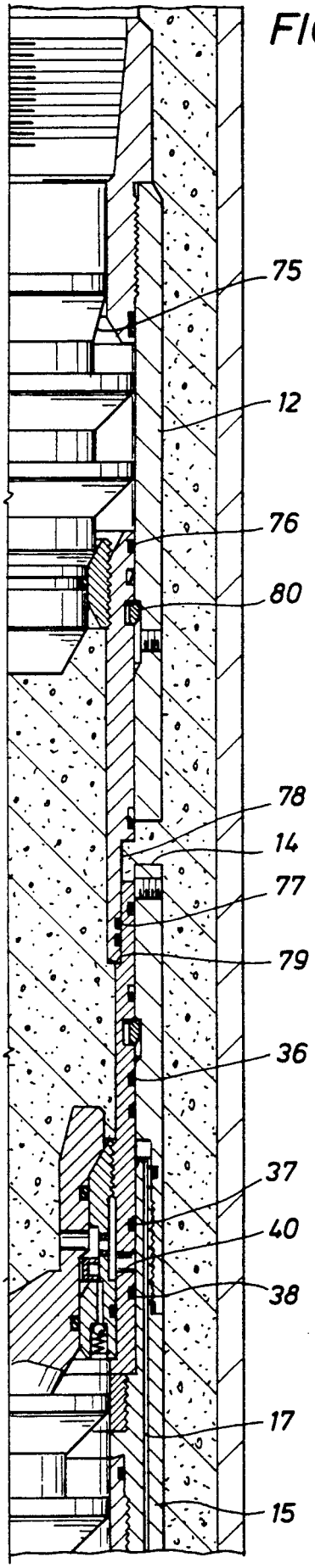

Following placement of the cement in the annulus, the ports 14 may be closed by means of a second tubular member or closing sleeve 70 disposed within the bore of the body above the opening sleeve 30. As shown, this tubular member is releasably connected to the body in the upper position of FIG. 3 by means of shear pins 71, and includes a sub 72 threadedly connected to the upper end of the pipe 73 to form an upwardly facing seat 74 at its upper end. Following placement of cement within the annulus, the ports 14 may be closed by the lowering of a second plug 75 through the casing string and onto a landed position on the seat 74, as shown in FIG. 4. Thus, with the plug so disposed, pressure fluid above it will shear the pin 71 and move the second sleeve downwardly into a position in which its lower end closes the ports 14. As shown, the plug carries wings which permit it to be pumped down into seated position.

As shown, seal rings 76 are carried about the upper end of the second tubular member for sealably engaging the bore of the body above the shear pin 71, and other seal rings 77 are carried about the reduced lower end 78 of the second member for sealably engaging the enlarged upper end of the first tubular member 30 or opening sleeve as the closing sleeve is lowered into the closing position of FIG. 4. The closing sleeve is located in its lower position by the landing of the reduced lower end upon a shoulder 79 formed on the enlarged inner diameter portion of the upper end of the first tubular member. The closing sleeve is held in its lower closing position by means of snap ring 80 carried about it for engaging a shoulder at the upper end of a recess 81 formed in the bore of the body.

As closing sleeve 70 moves downwardly to the position shown in FIG. 4 closing opening 14, seal rings 77 will move into sealing engagement with the upper end of opening sleeve 30 and immediately trap the cement inside the sleeves, forming a pressure lock that would prevent any further downward movement of the closing sleeve. To keep this from happening, means are provided to release cement from inside the sleeves when the pressure of the cement exceeds a preselected amount. In the embodiment shown, such means comprises a spring loaded check valve 54 located in a passageway in inner pipe 32 connecting the inside of opening sleeve 30 to the bore of the intermediate pipe 15. The check valve will allow sufficient cement to flow out of the sleeves to allow the closing sleeve to move to the closed position shown in FIG. 4.

Figure 5:
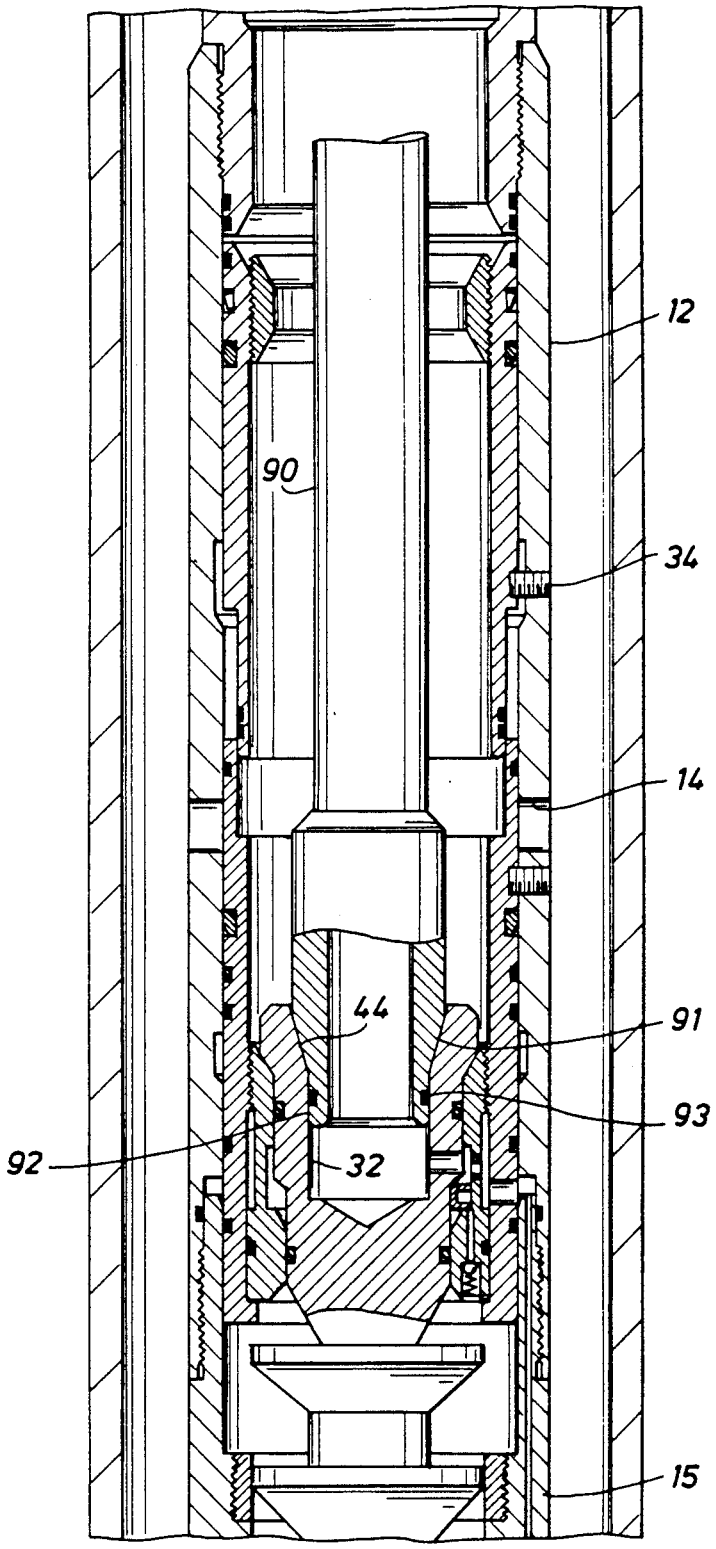

FIG. 5 shows the upper portion of the apparatus in the same position it is shown in FIG. 2A—i.e., upon lowering of the plug 50 into seated position on the first tubular member or opening sleeve so as to shear the closure of the port 41 and thus open the bore of the plug to the upper end of the passageway means 17 leading to the space between the packing element and lower body portion. As previously described, however, it may be found that, following inflation of the packer, the pressure of the fluid in the casing string above the plug is not sufficient to shear pins 34 and thus move the first tubular member downwardly to open the ports 14. Thus, in accordance with another novel aspect of the present invention, a pipe string such as drill pipe 90 has been lowered within the casing string to land at its lower end upon the plug 50. More particularly, the lower end of the pipe string 90 has a shoulder, such as conically shaped shoulder 91 for landing upon a shoulder, such as seat 44 at the upper end of the plug, whereby the weight of the pipe string may be slacked off to impose a downward force on the plug sufficient to shear the pins and thus lower member 30. The lower end of the pipe string also has a lower extension 92 which fits closely within the bore of the plug and which has a seal ring 93 carried thereabout for sealably engaging the bore above the port 41 therein, thereby permitting fluid pressure to be held on the packing element so as to maintain it inflated as the plug and thus the first tubular member are forced downwardly. Obviously, upon opening of the ports 14, the pipe string 90 may be removed, and cement may be circulated through the ports into the annulus, and the closing sleeve subsequently lowered to close the ports.

Figure 6:
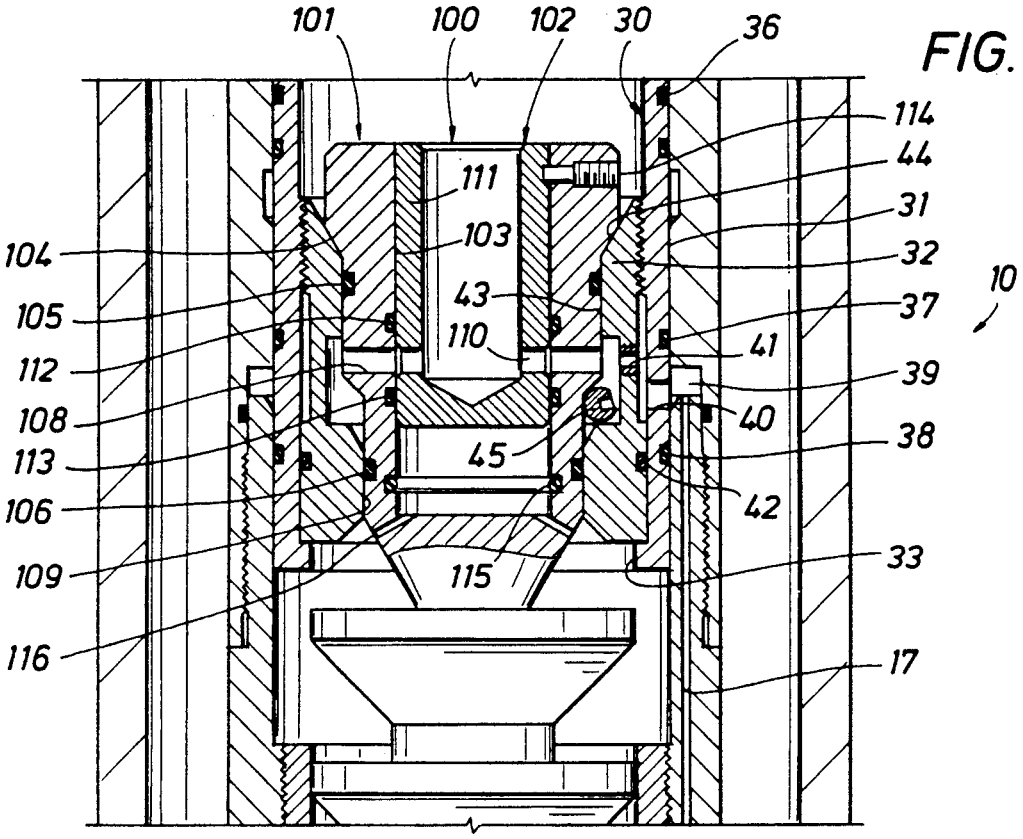
FIG. 6 is a vertical sectional view of a modified and preferred version of an opening plug lowered onto a seat in the opening sleeve, with the inner plug body thereof in its upper position with respect to the outer plug body to connect the port means of the plug with the sleeve to permit inflation of the packer.
Figure 7:
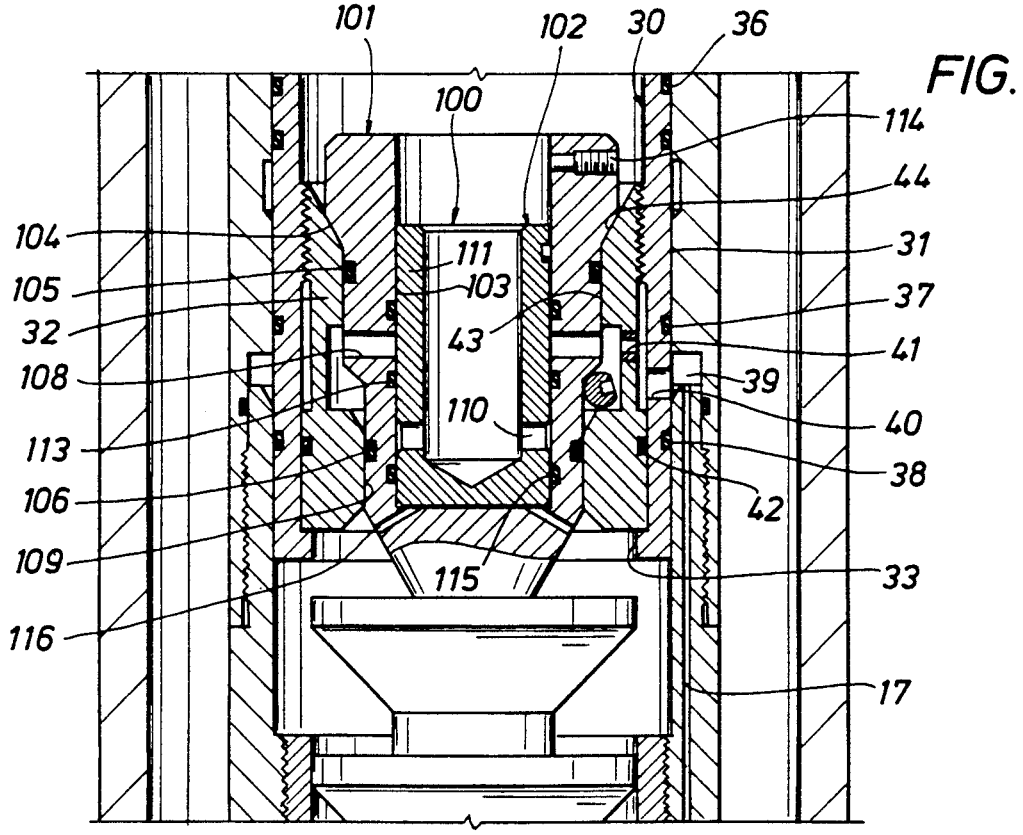
FIG. 7 is a view similar to FIG. 6, but upon lowering of the inner plug body to close the port means and thus the passageway means following inflation of the packer.

As previously mentioned, difficulty may be encountered, in the use of the above described apparatus, in causing the opening sleeve 30 to move downwardly to and remain at its lower position in order to close passageway 17 for containing inflating pressure within the packer, in which case it may be found desirable to use an opening plug constructed in accordance with the alternative embodiment of the invention, shown in FIGS. 6 and 7. Thus, the modified opening plug, which is indicated in its entirety by reference character 100, comprises an outer plug body 101 which is similar in construction to the opening plug 50 shown and described in connection with the prior figures of the drawings, as well as an inner plug body 102 disposable within a bore 103 in the outer plug body for movement between its upper position of FIG. 6 and its lower position of FIG. 7. As in the prior described plug, the outer plug body 101 includes a shoulder 104 adapted to land on the seat 44 on the bore of the opening sleeve 30, and carries an O-ring 105 thereabout for sealably engaging within the bore 43 in the opening sleeve beneath the seat 44 thereof, and another O-ring 106 about a reduced diameter portion 109 thereof for sealably engaging within the reduced bore in the lower end of the opening sleeve below ports 108 therein which connect its bore 103 with its outer side and which in turn is connected with the port 41 in the inner side of the opening sleeve leading to the port 40 in the outer side thereof, and thus the space 39 at the upper end of the passageway 17 leading to the packer.

The inner plug body 102 also has a port 110 formed therein which, in the upper position of the inner plug body shown in FIG. 6, is disposed opposite the port 108 formed in the outer plug body, the ports 108 and 110 thus forming port means connecting bore 111 in the inner plug body with the outer side of the inner plug body, and thus ultimately with the passageway means 17. O-rings 112 and 113 are carried about the bore 103 of the outer plug body for sealably engaging the outer side of the inner plug body above and below the ports 110 therein when the inner body is in its upper position, thereby confining flow of pressure fluid within the casing string above the plug for flow through the port means.

The inner plug body is initially held in its upper position by means of a shear pin 114 mounted in the outer plug body and extending into a recess in the inner plug body. This shear pin is so designed as to shear in response to the supply of fluid within the pipe string above the plug at the pressure above that for inflating the packer. Upon shearing of the pin 114, the inner plug body is forced downwardly to the lower position of FIG. 7 wherein its lower end lands on the lower end of the bore in the outer plug body. At this time, the outer ends of ports 10 are disposed between O-ring 113 and another O-ring 115 carried within the bore 103 of the outer plug body beneath the O-ring 113. As shown, ports 116 are formed in the lower end of the outer plug body to vent the space beneath the lower end of the inner plug body and the lower end of the bore in the outer plug body and thus permit the inner plug body to be moved downwardly.

When the inner plug body has been so lowered, the connection of the port means to passageway means 17 is closed so as to prevent pressure fluid from escaping from within the inflated packer, and the higher pressure to be applied in the casing upon lowering of the opening sleeve and circulation of cement out into the annulus from entering and thereby over inflating the packer. As previously described, due to the short length of the inner plug body, and thus the relatively short length of sliding engagement between the inner and outer plug bodies, the downward movement of the inner plug body to close the port means in the plug 100 is relatively reliable. More particularly, the plug 100 thus serves to close the port means and thus close the passageway 17 whether or not the inner sleeve is fully lowered to and held in its lower position.

The embodiment of the overall apparatus shown in FIG. 8 is similar in many respects to that of the overall apparatus shown in FIGS. 1A, 1B, 2A and 2B in that it has been lowered on a pipe string into a casing 9 to dispose it at a level in which a column of cement is to be applied between the string and the bore of the outer casing 9. Thus, similarly to the previously described apparatus, that shown in FIG. 8 includes a tubular body 120 having circulating ports (not shown) formed therein connecting the bore 121 of the body with its outer side and thus with the annulus about the body.

More particularly, the outer diameter of the lower end of the body is reduced, and a packing element 122 is mounted thereabout includes an outer sleeve of elastomeric material as in the apparatus previously described such that further detail is not necessary. Thus, the inner sleeve of the packing element is spaced outwardly from the outer diameter of the reduced portion of the body to provide an annular space between them connecting at its upper end with passageway means 123 formed in the outer body and connecting at its upper end with an annular space 124 to which fluid pressure means may be applied for the purpose of inflating the packer. As will be described to follow, this alternative embodiment of the apparatus differs from the previously described apparatus in the manner in which pressure fluid within the pipe string is supplied to the passageway 17 for inflating the packer and then contained within the packer to maintain it inflated as well as to prevent the supply of pressure at a higher level through the passageway means to the packer, which might otherwise over inflate and thus damage the packer.

Similarly to the previously described apparatus, that of FIG. 8 includes an opening sleeve or first tubular member 125 which is reciprocal within the bore of the body 120 between an upper position, as shown in FIG. 8, wherein it closes the circulating ports (not shown) in the body as well as connection with a space 124 within the body at the upper end of the passageway means 123 leading to the packer. The apparatus further includes a closing plug 126 which is landed within the bore of the lower end of the opening sleeve 125 so as to connect port means therethrough with ports through the tubular member leading to the space 124. As in the case of the previously described apparatus, lowering of the plug 126 into the position of FIG. 8 has sheared a closure 127 over the inner end of the port in the opening sleeve so that pressure fluid in the pipe string above the plug 126 will flow through the port means in the plug as well as the port in the opening sleeve and thus into the passageway means 17 for the purpose of inflating the packer.

As described in connection with the prior apparatus, when the packer has been inflated, as shown in FIG. 8, additional fluid pressure in the pipe string above the plug is intended to lower it and thus the opening sleeve to its lower position for closing the passageway means. For this purpose, a seal ring 128 carried about the outer side of the opening sleeve is so disposed as to be lowered to a position above the space 124, while another O-ring 129 about the sleeve has been lowered beneath the space 124, the imperforate portion of the opening sleeve intermediate the rings 128 and 129, thus closing off the upper end of the passageway means 17. However, in accordance with the embodiment of the apparatus shown in FIG. 8, valve means are provided in the body for closing the passageway means to not only contain pressure within the inflated packer, but also prevent the introduction to the packer of still higher pressure within the pipe string, automatically in response to the inflation of the packer at the desired pressure level and whether or not the O-rings 128 and 129 are properly positioned, and thus without reliance upon the intended operation of the opening sleeve. Thus, if desired, the O-rings 128 and 129 may be eliminated since they serve only as a secondary means of closing the passageway means.

For this purpose, valve means in the form of upper and lower valve members 130 and 131 are installed in the body 120 for controlling flow through the passageway means 123. Thus, as shown in FIGS. 9A to 9C, the upper valve member 130 is disposed within a bore 132 formed in the body to connect at its left-hand end with an upper segment 17A of the passageway means downstream of the space 124 and at its opposite end with the outer side of the body. The lower valve member 131 is disposed within a bore 133 formed in the body to connect intermediate its ends with an intermediate segment 17B of the passageway 17 and at its right-hand end with the outer side of the body. The upper end of the passageway means segment 17B connects with the bore 132 toward its left end and thus toward its connection with the passageway segment 17A. The bore 133 also connects with a lower segment 17C of the passageway means which leads to the space within the sleeve of the packer, the connection of the segment 17C with the bore 133 being disposed to the right of its connection with the lower end of the passageway segment 17B. As shown in FIG. 9A, the valve member 130 is initially urged by a coil spring to the left and held by a shear pin in a position closing the passageway 17 prior to the supply of pressure at a level for inflating the packer. At this same time, the lower valve member 131 is also held by a shear pin in the position shown in FIG. 9A so as to connect the passageway segments 17B and 17C with one another. For this purpose, the valve member 131 has spaced left and right-hand heads 31A and 131B, each carrying seal rings for sealably engaging the bore 133 as the valve member 131 reciprocates therein. When the valve member 131 is held in its left position, the head 131A is to the left of passageway segment 17B and the head 131B is to the right of the passageway segment 17C, thus connecting them to open the passageway beneath the valve member 130.

The valve member 130 includes a head 130A at its left end which is spring pressed to the closed position show in FIG. 9 and held therein by a shear pin which is adapted to shear in response to the supply of fluid pressure to the passageway 17 during inflation of the packer. As the pin is sheared, the valve member 130 is urged to the right-hand position shown in FIG. 9B so as to connect passageway segment 17A with passageway segment 17B of the passageway means, thus permitting pressure fluid to pass into segment 17C and through the passageway means into the packer for inflating it.

An additional passageway 146 is formed in the body of the apparatus to connect the space between the packer sleeve and the body with the left-hand end of the bore 133, whereby pressure in the space is effective over the left-hand end of the head 131A of the valve member 131 to shear the pin holding it open and then urge it to the right, thus to the position shown in FIG. 9C for closing the passageway means when the packer has been inflated. At this time, as shown in FIG. 9C, one of the O-rings about the head 131A sealably engages the bore 133 intermediate its connection with the passageway segments 17B and 17C, thus preventing communication between the passageway segments 17B and 17C. As a result, the valve member 131 will contain pressure within the packer to hold it inflated and cannot be urged from the right-hand open position of FIG. 9C, regardless of the pressure which might be applied thereto through the passageway means 17 upstream of it.

When pressure in the pipe string is relieved, the upper valve member 130 will be urged to the right and thus back to the position shown in FIG. 9A. It will then be held in such position by means of a ring adapted to be urged to a cocked position as the rod on the right-hand end of the valve member 130 is withdrawn from within the ring. This then will lock the upper valve member 130 in its closed position, thus providing a secondary closure for the passageway means.

As previously described, the alternative form of closing sleeve and closing plug shown in FIGS. 10 and 11, and indicated in their entireties by reference characters 220 and 221, respectively, are of such construction as to prevent the substantial return of cement from the annulus through the circulating ports 14 even though the closing sleeve is not lowered and locked in its closing position. As in the case of the closing sleeve 70, sleeve 220 is disposed within the bore of the body 10 and carries an O-ring 226 thereabout for sealably reciprocating therein above the opening sleeve 30. This closing is initially retained in its upper position by means of shear pins 222 releasably connecting it to the body. The closing sleeve has a seat 223 at its upper end, and the closing plug 221 has a shoulder 224 which is adapted to land on the seat as well as wings above the shoulder which permit it to be pumped downwardly to seated position. When the plug is so landed, fluid pressure thereabove is effective to shear the pins 222, and thus move the closing sleeve downwardly with it toward closing position. As in the case of the closing sleeve 70, the lower end of sleeve 220 has a reduced diameter portion carrying O-rings 225 thereabout for sliding into and sealably engaging the enlarged diameter of the upper end of the bore in opening sleeve 30, thereby closing the circulating ports.

As in the case of the sleeve 70, sleeve 220 carries an expandable locking ring 227 thereabout which is intended to move outwardly into a groove 228 about the bore of the body as the sleeve is lowered into a landed position on a shoulder 230 within the bore of the opening sleeve 30. However, as shown in FIG. 10, the locking means may not, for one or more various reasons, move into a position beneath the upper end of the groove 228, or even if it is lowered to the position, expand outwardly into the groove, in any event failing to be locked in its lower closing position. Unless locked in this lower position, the closing sleeve would be forced upwardly due to the downwardly facing differential pressure area between the seal rings 225 and 226, thus permitting cement within the annulus to flow through the ports 14 into the bore of the body 10 beneath the closing plug 221. Consequently, unless the closing sleeve was held downwardly by pressure above the plug as the cement column hardened, cement would be free to flow upwardly within the pipe string. However, and, as previously described, the lowering of pressure above the plug following hardening of the cement may permit contraction of the casing and void between it and the cement column.

As also previously described, however, the closing sleeve and plug are provided with means for retaining the plug in a position closing the bore through the closing sleeve, while the cement column hardens so that there is no need to maintain and then reduce pressure above the plug. For this purpose, an expandable locking ring 230 is carried within a groove 231 about the closing plug beneath the landing shoulder 224 thereon, so that the closing plug is lowered into the bore of the closing sleeve beneath the seat 223, the locking ring 230 is adapted to expand outwardly into a groove 232 formed about the bore of the closing sleeve beneath the seat 223. More particularly, an O-ring 233 is carried about the closing plug beneath the locking ring 230 in position to sealably engage the bore of the closing sleeve when the closing plug is locked down in the closing sleeve by engagement of the locking ring 230 with the upper end of the groove 232. In this way, cement which may circulate back through the ports 14 and into the bore of the closing sleeve beneath the plug is retained despite the failure of the closing sleeve to move to its locked position within the bore of the body.

As shown, the groove 232 is of such length that it permits the locking ring 230 to move downwardly within it to a position in which the O-ring 233 is removed from sealing position within the bore of the closing sleeve. At this time, the landing shoulder 224 about the closing plug is above the seat 223 so as to form a bypass between the plug and sleeve thus permitting fluid beneath the plug to flow therethrough into the bore of the body above the closing sleeve. Thus, as the closing sleeve is moved downwardly with the plug due to pressure thereabove, the movement of its lower end into the upper enlarged bore of the opening sleeve 30 will prevent displacement of further cement through the circulating ports 14, whereby pressure beneath the plug will cause it to rise, as shown in FIG. 10, to relieve the build up in pressure. Then, pressure acting upon the upwardly facing differential area between the O-rings 225 and 226 will force the closing sleeve downwardly, thus again building up a higher pressure below the plug, the plug thus continuing to shuttle or reciprocate these short distances until cement has been circulated through the ports 14 into the annulus between the stage collar and well bore, following which the plug will then be moved upwardly to its position shown in FIG. 11 for closing the bore through the closing sleeve. At this time, the upper end of the closing sleeve is free to move upwardly until its upper end engages a shoulder 234 in the bore of the body, thus limiting further upward movement of the closing sleeve and closing plug.

As shown, the locking ring 230 has a lower conical surface about its outer side to permit it to be contracted inwardly as it engages and slides downwardly over the seat 223 on the upper end of the closing sleeve.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for use in placing cement at a desired location within the annulus between a casing string and a well bore, comprising a body having a bore therethrough which is connectible as part of the casing string for lowering therewith into the well bore and a port connecting its bore with its outer side, a packing element including an inflatable sleeve surrounding the body below the port, said body having passageway means therein connecting its bore with a space between the sleeve and body, a tubular member having a bore therethrough with an upwardly facing seat thereabout and passageway means therein connecting its bore with its outer side, said member being disposed within the bore of the body for vertical reciprocation between an upper position in which it closes the port in the body and its passageway means connects with the passageway means in the body and a lower position in which it opens said port and closes the passageway means in each of the member and body, shear means releasably connecting the tubular member to the body in its upper position, a plug lowerable through the casing string into a landed position on the seat in the member, said plug having port means therethrough and being sealably engageable with the bore of the member, when landed on the seat, to connect the port means and thus the casing string thereabove with the passageway means in the member, said member having means thereon for closing its passageway means but adapted to be moved to open position by the plug, as the plug is landed, whereby pressure fluid in the casing string above the plug may be supplied to the space in order to inflate and expand the sleeve of the packing element into engagement with the well bore beneath the port and then shear the releasable connection of the member to the body and move the member to its lower position in which cement may be circulated through the open port in the body and into the annulus above the inflated sleeve, and means on the member and body for locating and holding the member in the lower position.

2. Apparatus of the character defined in claim 1, wherein the body has a lower reduced outer diameter portion, and the sleeve is fixed to the upper body portion to surround the lower portion, and the packing element also includes a ring on the lower end of the sleeve for sealably sliding along the lower body portion.

3. Apparatus of the character defined in claim 2, wherein the sleeve is made of an elastomeric material and has metal strips extending between its upper and lower ends, and the ring and lower portion of the body have means engageable within one another as the ring is raised so as to hold the sleeve expanded and in engagement with the well bore.

4. Apparatus of the character defined in claim 1, wherein the passageway means in each of the body and member are closed by means for sealing between an imperforate portion of the outer side of the member and the bore of the body above and below the connection of the passageway means in the body upon movement of the member to its lower position.

5. Apparatus of the character defined in claim 4, wherein the sealing means is slidable along equal diameter portions of the member and body.

6. Apparatus of the character defined in claim 1, wherein the means closing the connection of the passageway means in the member is a closure mounted in the passageway means and extending into the bore of the member in order to be engaged and thereby removed from the passageway means by the plug as it is lowered into landed position.

7. Apparatus of the character defined in claim 1, wherein the plug has an upwardly facing seat above the port therein so that a pipe string may be lowered onto the seat and sealed with respect to the plug above the port to permit pressure fluid to be circulated downwardly therethrough and into the port and a downward force to be applied by the pipe string to the plug to shear the connection of the member to the body and force the member to its lower position.

8. Apparatus of the character defined in claim 1, including another tubular member vertically reciprocable within the bore of the body above the first mentioned member between an upper position in which it opens the port during circulation of cement through the port and a lower position in which it closes the port following circulation of cement, shear means releasably connecting the other member in its upper position, another plug lowerable through the casing string and into a landed position in the other tubular member, whereby pressure fluid above it is effective to release the shear means and lower the other member, and means for locating and holding the other member in its lower position.

9. Apparatus of the character defined in any one of claim 1, wherein said plug also includes an outer plug body having a bore therein and disposable within the bore of the tubular member for landing on the seat, an inner plug body having a bore therein and disposable within the bore of the outer plug body for moving between upper and lower positions therein, said port means comprises ports in each of the inner and outer plug bodies connecting their bores with their outer sides, means sealing between the first and second plug bodies and between the outer plug body and the bore of the member so as to connect the ports and thus connect the port means with the passageway means in the member when the inner plug body is in its upper position, means venting the space between the lower ends of the plugs, means holding said inner plug body in its upper position but releasable, in response to an increase in fluid pressure in the casing above the plug above that required to inflate the sleeve, but less that required to move the member to its lower position so as to lower the inner plug body to its lower position, and means sealing between the plug bodies to close the connection between their ports and thus close the port means when the inner plug body is moved to its lower position.

10. Apparatus for use in placing cement at a desired location within the annulus between a casing string and a well bore, comprising a body having a bore therethrough which is connectible as part of the casing string for lowering therewith into the well bore and a port connecting its bore with its outer side, a packing element including an inflatable sleeve surrounding the body below the port, said body having passageway means therein connecting its bore with a space between the sleeve and body, a tubular member having a bore therethrough with an upwardly facing seat thereabout and passageway means therein connecting its bore with its outer side, said member being disposed within the bore of the body for vertical reciprocation between an upper position in which it closes the port in the body and its passageway means connects with the passageway means in the body and a lower position in which it opens said port, shear means releasably connecting the tubular member to the body in its upper position, a plug lowerable through the casing string into a landed position on the seat in the member, said plug having port means therethrough and being sealably engageable with the bore of the member, when landed on the seat, to connect the port means and thus the casing string thereabove with the passageway means in the member, said member having means thereon for closing its passageway means but adapted to be moved to open position by the plug, as the plug is landed, whereby pressure fluid in the casing string above the plug may be supplied to the space in order to inflate and expand the sleeve of the packing element into engagement with the well bore beneath the port and then shear the releasable connection of the member to the body and move the member to its lower position in which cement may be circulated through the open port in the body and into the annulus above the inflated sleeve, means for closing the passageway means in order to contain such pressure fluid within the space and prevent the supply thereto of additional pressure fluid in the casing string above the plug following inflation of the sleeve, and means on the member and body for locating and holding the member in the lower position.

11. Apparatus of the character defined in claim 10, wherein the shear means connecting the member to the body is shearable in response to fluid pressure in the casing string above the plug which is greater than that which was required to inflate the sleeve, and the means for closing the passageway means comprises means for sealing between an imperforate portion of the outer side of the member and the bore of the body above and below the connection of the passageway means in the body upon movement of the member to its lower position.

12. Apparatus of the character defined in claim 11, wherein the sealing means on the member and body are sealably slidable along equal diameter portions of each.

13. Apparatus of the character defined in claim 10, wherein the means for closing the passageway means comprises valve means including a valve member installed in the body for movement between positions opening and closing the passageway means in the body, means holding the valve member in open position, and means responsive to the supply to the passageway means of pressure fluid to inflate the sleeve for releasing the valve member and moving it to closed position in which it is held by the fluid pressure in the space regardless of fluid pressure supplied to the casing.

14. Apparatus of the character defined in claim 13, wherein said valve means also includes an additional valve member installed in the body for movement between positions opening and closing passageway means in the body upstream of the first mentioned valve member, means urging the additional valve member to closed position but yieldable to permit the additional valve member to be moved to open position in response to the supply of said pressure fluid to the passageway means for inflating the sleeve, and means for locking said additional valve member in its closed position when returned thereto by said urging means upon the reduction of pressure fluid.

15. Apparatus of the character defined in claim 10, wherein the body has a lower reduced outer diameter portion, and the sleeve is fixed to the upper body portion to surround the lower portion, and the packing element also includes a ring on the lower end of the sleeve for sealably sliding along the lower body portion.

16. Apparatus of the character defined in claim 15, wherein the sleeve is made of an elastomeric material and has metal strips extending between its upper and lower ends, and the ring and lower portion of the body have means engageable with one another as the ring is raised so as to hold the sleeve expanded and in engagement with the well bore.

17. Apparatus of the character defined in any of claims 10, 11 and 13, wherein the means closing the connection of the passageway means in the member is a closure mounted in the passageway means and extending into the bore of the member in order to be engaged and thereby removed from the passageway means by the plug as it is lowered in to landed position.

18. Apparatus of the character defined in claim 10, wherein the plug has an upwardly facing seat above the port therein so that a pipe string may be lowered through the casing string and onto the seat and sealed with respect to the plug above the port to permit pressure fluid to be circulated downwardly therethrough and into the port and a downward force to be applied by the pipe string to the plug to shear the connection of the member to the body and force the member to its lower position.

19. Apparatus of the character defined in claim 10, including another tubular member vertically reciprocable within the bore of the body above the first mentioned member between an upper position in which it opens the port during circulation of cement through the port and a lower position in which it closes the port following circulation of cement, shear means releasably connecting the other member in its upper position, another plug lowerable through the casing string and into a landed position on the other tubular member, whereby pressure fluid above it is effective to release the shear means and lower the other member, and means for locating and holding the other member in its lower position.

20. Apparatus for use in placing cement at a desired location within the annulus between a casing string and a well bore, comprising a body having a bore therethrough which is connectible as part of the casing string for lowering therewith into the well bore and a port connecting its bore with its outer side, a first tubular member having a bore therethrough and sealably reciprocable within the bore of the body between an upper position in which it closes the port in the body and a lower position in which it opens the port, shear means releasably connecting the first tubular member to the body in its upper position, means responsive to pressure fluid in the casing string for moving the first member to its lower position, a second tubular member having a bore therethrough with an upwardly facing seat and sealably reciprocable within the bore of the body above the first member between an upper position in which it opens the port, during circulation of cement therethrough, and a lower position in which it is sealably slidable within the first member to close the port following circulation of cement through the port, second shear means releasably connecting the second member in its upper position, a plug lowerable through the casing string and the bore of the second member for landing on the seat thereof, whereby pressure fluid within the casing string above it is effective to release the second shear means and move the second member to its lower position, said body and second member having means for locking the second member in its lower position as it is moved to its lower position, means for connecting the plug to the second member, as the plug is lowered into the bore of the second member, so as to permit said plug to reciprocate within said bore between a lower position in which it is landed on the seat of the second member and an upper position in which it is raised from the seat, and means on the plug which sealably engages the bore of the second member in the upper position of the plug but which is removed from the bore to open a flow path between the second plug and bore of the second member as the second plug is lowered toward its landed position, said second member and bore of the body having means thereon to limit movement of the body upwardly beyond its upper position.

21. Apparatus of the character defined in claim 1, wherein the locking means comprises a groove about one of said bore of the second member and outer side of the plug, and expandable and retractable locking means carried by the other of the outer side of the plug and bore of the plug for moving into the groove as the plug is lowered into the bore of the second member, said groove being of a length to permit said plug to reciprocate between its upper position and lower landed position.

22. In a method of placing a column of cement at a desired location between a casing string and a well bore by means of a stage collar comprising a body having a bore therethrough connected to a pipe string, a sleeve reciprocable within the bore between an upper position in which it is releasably connected to the body to close a port in the body connecting its bore with its outer side and a lower position in which it opens the port to permit cement to be circulated therethrough, a plug lowerable through the pipe string and onto the sleeve to permit pressure fluid in the string above the plug to release the connection and lower the sleeve to its lower position, and an inflatable packer element mounted on the body beneath the port with its interior connectable to the bore of the body by normally closed passageway means, the steps of lowering the stage collar body with the pipe string to dispose the packing element beneath the desired location within the well bore, lowering the plug onto the sleeve to open the passageway means, supplying fluid pressure to the pipe string above the plug and through the passageway means in order to inflate the packing element, and raising the level of fluid pressure in the pipe string above the plug in order to release the sleeve from its connection to the body and move it with the plug to its lower position opening the port as well as closing the passageway means in order to contain pressure fluid therein and prevent the introduction of additional pressure fluid to the inflated packing element.

23. In a method of placing a column of cement at a desired location between ca string and a well bore by means of a stage collar comprising a body having a bore therethrough connected to a pipe string, a sleeve reciprocable within the bore between a first position in which it is releasably connected to the body to close a port in the body connecting its bore with its outer side and a second position in which it opens the port to permit cement to be circulated therethrough, and an inflatable packer element mounted on the body beneath the port with its interior connectible to the bore of the body by passageway mean having valve means therein which is normally closed but which is adapted to open in response to the supply of pressure fluid in the pipe string for inflating the packing element and then close when the packing element is inflated to the desired pressure in order to contain pressure in and prevent the supply of additional pressure to the packing element, the steps of lowering the stage collar body with the pipe string to dispose the packing element beneath the desired location within the well bore, supplying fluid pressure to the pipe string and through the passageway means in order to open and then close the valve means to inflate the packing element, raising fluid pressure in the pipe string to a level above that for inflating the packer in order to release the sleeve from its connection to the body and move it to its position opening the port.

24. In a method of placing a column of cement at a desired location between a casing string and a well bore by means of a stage collar comprising a body having a bore therethrough connected to a pipe string, a sleeve reciprocable within the bore between an upper position in which it is releasably connected to the body to close a port in the body connecting its bore with its outer side and a lower position in which it opens the port to permit cement to be circulated therethrough, a plug lowerable through the pipe string and onto the sleeve to permit pressure fluid in the string above the plug in the string to release the connection and lower the sleeve to its lower position, an inflatable packer element mounted on the body beneath the port with its interior connectible to the bore of the body by passageway means, which has a closure at its end connecting with the bore of the sleeve and which has valve means therein which is adapted to close when the packing element is inflated to the desired pressure in order to contain pressure in and prevent the supply of additional pressure to the packing element, the steps of lowering the stage collar body with the pipe string to dispose the packing element beneath the desired location within the well bore, lowering the plug onto the sleeve to open the closure, supplying fluid pressure to the pipe string above the plug and through past the closure and the passageway means in order to inflate the packing element, and raising the level of fluid pressure in the pipe string above the plug in order to release the sleeve from its connection to the body and move it with the plug to its lower position opening the port.

* * * * *